United States Patent [19]

Sugiura

[11] Patent Number: 4,499,874

[45] Date of Patent: Feb. 19, 1985

[54] SYSTEM FOR CONTROLLING THE IGNITION TIMING OF AN ENGINE

[75] Inventor: Katsuhiko Sugiura, Tama, Japan

[73] Assignee: Fuji Jukogyo Kabushiki Kaisha, Tokyo, Japan

[21] Appl. No.: 586,573

[22] Filed: Mar. 5, 1984

[30] Foreign Application Priority Data

Mar. 7, 1983 [JP] Japan ..... 58-37185

[51] Int. Cl.[3] ..... F02P 5/04

[52] U.S. Cl. ..... 123/407; 123/421

[58] Field of Search ..... 123/407, 408, 409, 421

[56] References Cited

U.S. PATENT DOCUMENTS 4,177,776 12/1979 Kawai et al. ..... 123/407 X

FOREIGN PATENT DOCUMENTS 2906243 8/1980 Fed. Rep. of Germany ..... 123/408
99066 8/1981 Japan .
62371 4/1983 Japan ..... 123/407

*Primary Examiner*—Tony M. Argenbright
*Attorney, Agent, or Firm*—Martin A. Farber

[57] ABSTRACT

A system for controlling the ignition timing of an engine provided with a supercharger. The system comprises a vacuum advance device comprising two chambers defined by a diaphragm and a rod connecting the diaphragm to an advance mechanism of a distributor of the engine. The vacuum advance device is operated by the pressure in the intake passage at upstream side of the throttle valve of the engine and the pressure at a signal port provided on the wall of the intake passage at a position just above the throttle valve. The signal port is connected to one of the chambers. A solenoid operated three-way valve having three ports is provided. The three-way valve has a first port communicated with the other chamber of the vacuum advance device, a second port communicated with the intake passage at the upstream side of the throttle valve, and a third port communicated with the atmosphere. A thermo switch responsive to temperature of the engine is provided for operating the three-way valve so as to open the third port and to close the second port at temperature higher than a predetermined temperature and to close the third port and to open the second port at temperature lower than the predetermined temperature where knocking hardly occurs. The vacuum advance device is so arranged that the diaphragm is deflected by the pressure in the intake passage in the advance direction at the lower temperature conditions to provide advanced ignition timings.

3 Claims, 3 Drawing Figures

SYSTEM FOR CONTROLLING THE IGNITION TIMING OF AN ENGINE

BACKGROUND OF THE INVENTION

The present invention relates to a system for controlling the ignition timing of an internal combustion engine having a turbocharger, and more particularly to a system for controlling the ignition timing at cold engine operation.

In the engine having a turbocharger, the pressure of intake air greatly increases during supercharging operation, which results in an increase of the pressure of mixture compressed in cylinders. Such a high pressure is apt to induce "knocking" in the engine.

Japanese patent laid open 56-99066 discloses a system for preventing the knocking. The system is adapted to control the ignition timing in the retard direction during supercharging operation and to control the timing in the advance direction at non-supercharging operation. However, the knocking does not occur at cold engine operation or at low temperature of intake air, since the detonation causing the knocking occurs under conditions of high compression pressure at high temperature in cylinders. In the system of the prior art, ignition timing is retarded also in such a cold engine condition that knocking hardly occur, which decreases operability of the engine.

SUMMARY OF THE INVENTION

The object of the present invention is to provide a system which is provided with a vacuum advance device and thermo sensitive valve device for operating the vacuum advance device at low temperature of the engine so as to advance ignition timing.

The present invention provides a system for controlling the ignition timing of an engine provided with a supercharger having a compressor provided in an intake passage of the engine, comprising:

a vacuum advance device comprising two chambers defined by a diaphragm and a rod connecting the diaphragm to an advance mechanism of a distributor of the engine.

A signal port is provided in the wall of the intake passage at a position just above a throttle valve the pressure at which varies with the variation of the opening degree of the throttle valve, and the signal port is communicated with one of the chambers. A solenoid operated three-way valve having three ports is provided. The three-way valve has a first port communicated with the other chamber of the vacuum advance device, a second port communicated with the intake passage at the upstream side of the throttle valve, and a third port communicated with the atmosphere. A thermo switch responsive to engine temperature is provided for operating the three-way valve so as to open the third port and to close the second port at temperature higher than a predetermined temperature and to close the third port and to open the second port at temperature lower than the predetermined temperature where knocking hardly occur. The vacuum advance device is so arranged that the diaphragm is deflected by the pressure in the intake passage in the advance direction at the lower temperature conditions for providing advanced ignition timings.

The other objects and features of this invention will be apparently understood from the following description with reference to the accompanying drawings.

DETAILED DESCRIPTION OF THE PREFERRED EMBODIMENT

Figure 1:
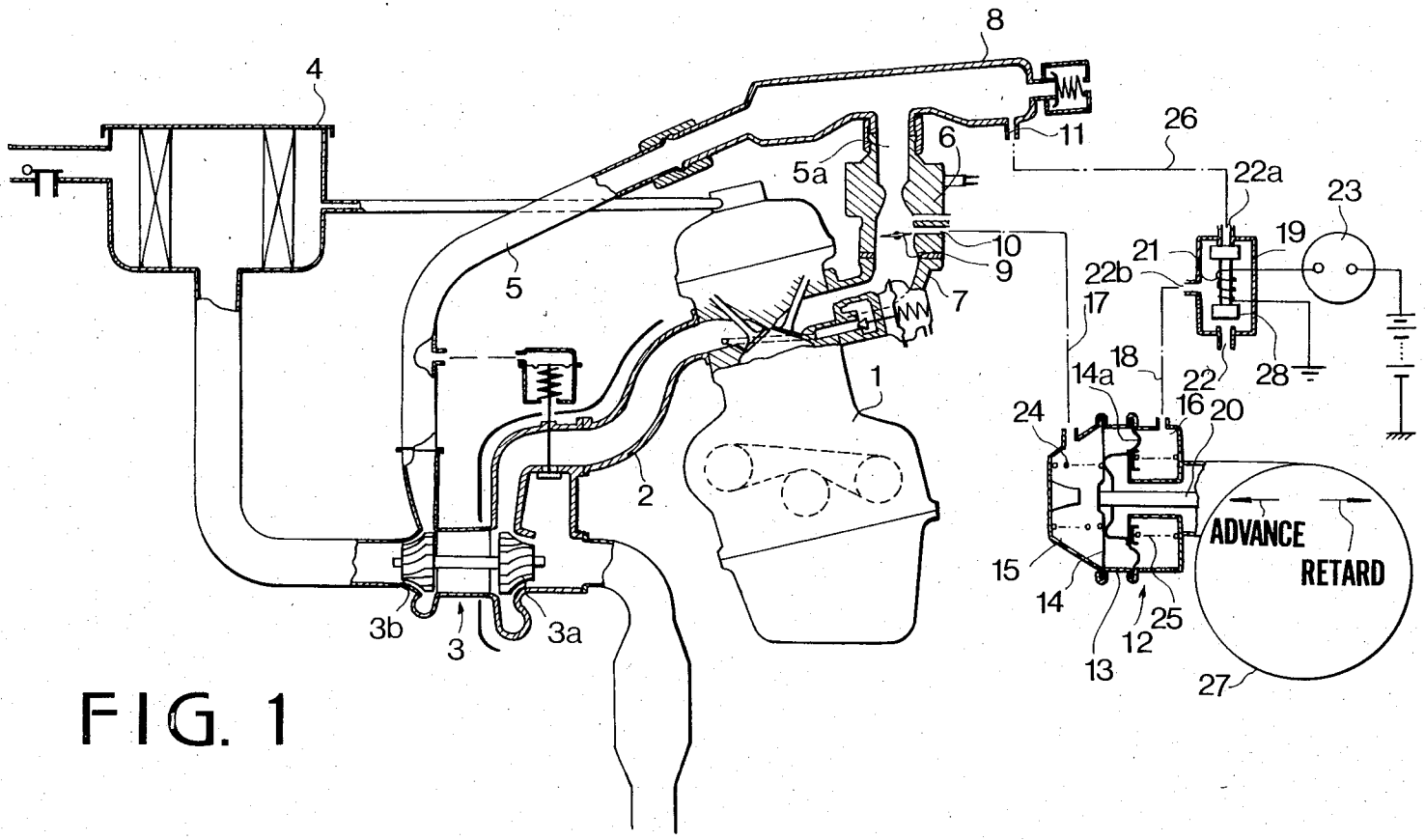
FIG. 1 is a schematic view showing a system according to the present invention.

Referring to FIG. 1, an internal combustion engine 1 is provided with a turbocharger 3 as a supercharger. The turbocharger 3 comprises a turbine 3*a* provided in an exhaust pipe 2 and a compressor 3*b* provided in an intake pipe 5 at the downstream side of an air-cleaner 4. The intake pipe 5 is communicated with an intake passage 5*a* at the upstream side of a carburetor 6 through a chamber 8 having a predetermined volume. The chamber 8 serves to diminish the pulsation of intake air pressure. The carburetor 6 communicates with the engine 1 through an intake manifold 7. A signal port 10 is provided in the wall of the carburetor 6 positioned just above the upward swinging end of a throttle valve 9 in its closed position, so that it is exposed to induction vacuum when the throttle is slightly opened. Another signal port 11 is provided in the wall of the chamber 8. A vacuum advance device 12 is employed in the system. The vacuum advance device 12 comprises a housing 13, pressure chambers 15 and 16 defined by diaphragms 14 and 14*a*. The diaphragm 14 is connected to an advance mechanism of a distributor 27 by a rod 20. Chamber 15 is communicated with the signal port 10 through a passage 17 and chamber 16 is communicated with the signal port 11 through a passage 18, three-way directional control valve 19, and passage 26. Diaphragm 14 is urged by a spring 24 in the retard direction and diaphragm 14*a* is urged by a spring 25 in the advance direction. The directional control valve 19 comprises a piston 28, solenoid 21, and ports 22, 22*a*, 22*b*. The port 22 is communicated with the atmosphere. Port 22*b* is selectively communicated with port 22 or 22*a* in dependence on the position of piston 28. The solenoid 21 is electrically connected to a thermo sensor or switch 23 which is adapted to be closed when the temperature of the coolant of the engine is below a predetermined low temperature.

Figure 2:
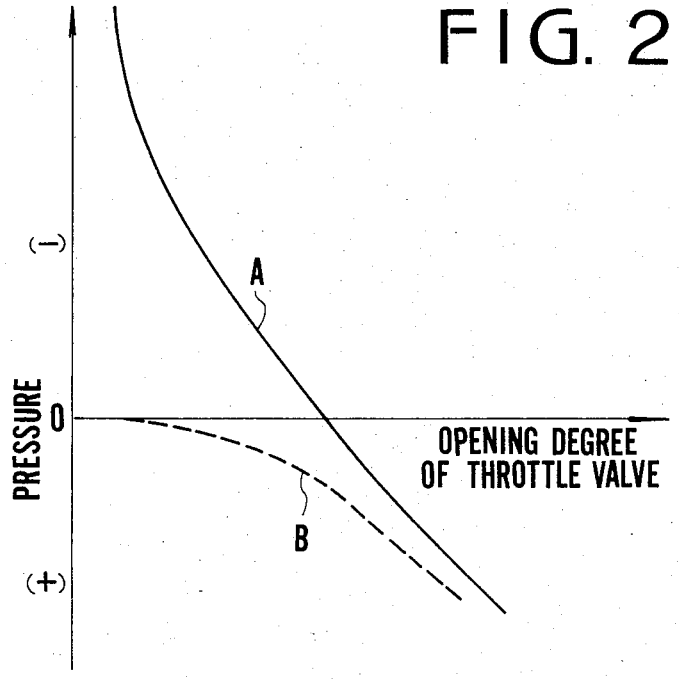
FIG. 2 is a graph showing a relationship between the opening degree of a throttle valve and the pressure in an intake passage of an engine.
Figure 3:
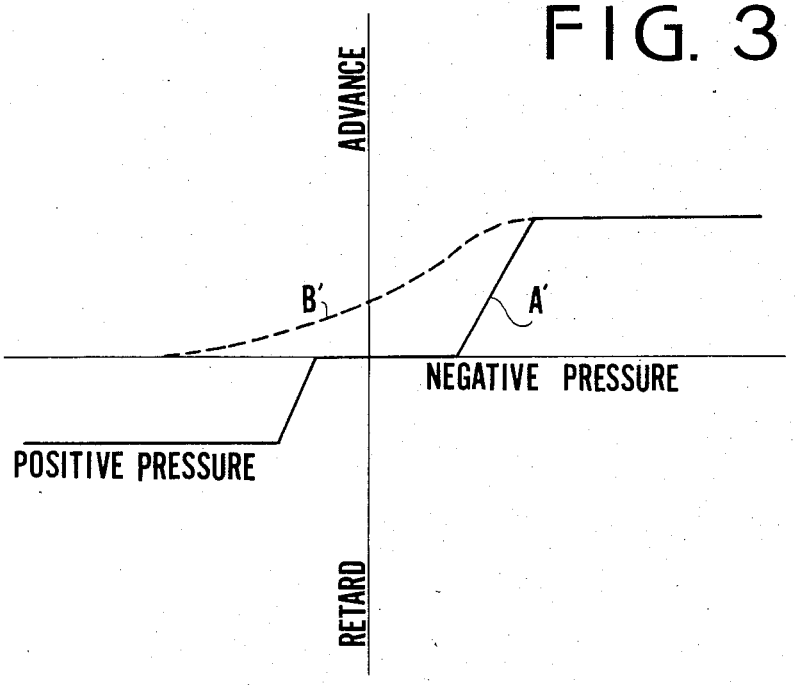
FIG. 3 is a graph showing ignition characteristics in a system of the present invention.

In operation, when the temperature of the coolant is higher than the set temperature, thermo switch 23 is opened, thereby opening the port 22 as shown in FIG. 1. Accordingly, the pressure in the chamber 16 is at the atmospheric pressure. On the other hand, chamber 15 is applied with the pressure at the port 10 and the pressure in the chamber 15 is dependent on the position of throttle valve 9. Line A of FIG. 2 shows the pressure at the port 10. When the opening degree of throttle valve 9 is smaller than a predetermined value, the turbocharger 3 does not operate to supercharge. In such a condition of small opening degree of the throttle valve, the vacuum pressure at the port 10, that is the pressure in the chamber 15 deflects the diaphragm 14 in the advance direction against the spring 24. Accordingly, the ignition timing is advanced. When the throttle valve 9 is opened over a predetermined degree, the pressure at the port 10 becomes positive. Further, when the throttle valve opening degree exceeds a predetermined value, turbocharger 3 begins to supercharge and the pressure at port 10 further rises, so that diaphragm 14 is deflected in the retard direction. Thus, ignition timing is retarded so as to prevent the occurrence of knocking. Line A' of FIG. 3 shows an ignition timing characteristic of a system according to the present invention.

When the temperature of the coolant of the engine is lower than the set temperature, thermo switch 23 closes to energize solenoid 21. Accordingly, the piston 28 is moved to close port 22 and to open the port 22*a*. Thus, chamber 16 is communicated with chamber 8 through passage 18, valve 19 and passage 26. As a result, the pressure in the chamber 16 varies with throttle opening degree as shown by B in FIG. 2. Therefore, diaphragms 14 and 14*a* are deflected by the difference between pressures at chamber 8 and port 10, so that ignition timing is controlled in dependency on driving conditions. When supercharging is not effected during slight open throttle operation, the pressure in the chamber 8 is substantially equal to the atmospheric pressure and the pressure at port 10 is negative. Accordingly, the ignition timing is largely advanced by a large difference between pressures at chamber 8 and port 10. As throttle valve 9 is progressively opened, the pressure at port 10 increases, which results in decrease of the pressure difference. Therefore, magnitude of advance decreases in dependency on the throttle position. Line B' of FIG. 3 shows an ignition timing characteristic during cold engine operation.

In accordance with the present invention, as stated above, ignition timing is advanced under conditions of cold engine operations or low temperature of intake air where knocking hardly occur, so that engine performance can be improved.

While the presently referred embodiment of the present invention has been shown and described, it is to be understood that this disclosure is for the purpose of illustration and that various charges and modifications may be made without departing from the spirit and scope of the invention as set forth in the appended claim.

What is claimed is:

1. A system for controlling the ignition timing of an engine provided with a distributor, a throttle valve, and a supercharger having a compressor provided in an intake passage of the engine, comprising;

a vacuum advance device comprising two chambers defined by at least one diaphragm and a rod connecting said diaphragm to an advance mechanism of said distributor;

a signal port provided in the wall of said intake passage at a position the pressure at which varies with the variation of the opening degree of said throttle valve;

a first passage communicating one of said chambers with said signal port;

three-way valve means having three ports, said three-way valve means having a first port communicated with the other chamber of said vacuum advance device, a second port communicated with said intake passage at the upstream side of the throttle valve, and a third port communicated with the atmosphere;

means responsive to temperature for operating said three-way valve means so as to open said third port and to close said second port at temperature higher than a predetermined temperature and to close said third port and to open said second port at temperature lower than said predetermined temperature where knocking hardly occurs, said vacuum advance device being so arranged that said diaphragm is deflected by the pressure in the intake passage in the advance direction at said lower temperature conditions.

2. The system for controlling the ignition timing of an engine according to claim 1 wherein said three-way valve means is a solenoid operated valve comprising a piston and a solenoid for shifting the piston, and said means is a thermo switch responsive to engine temperature to close at said lower temperature and electrically connected to said solenoid for operating the valve.

3. The system for controlling the ignition timing of an engine according to the claim 1 wherein said signal port is located at a position just above the throttle valve so as to apply vacuum to said chamber when the throttle valve is partly opened, so that the ignition timing is advanced.

* * * * *